US008261489B2

(12) United States Patent
Gallenschuetz

(10) Patent No.: US 8,261,489 B2
(45) Date of Patent: Sep. 11, 2012

(54) ACCESS LOCK

(76) Inventor: Thomas Gallenschuetz, Buehl (DE)

( * ) Notice: Subject to any disclaimer, the term of this patent is extended or adjusted under 35 U.S.C. 154(b) by 402 days.

(21) Appl. No.: 12/452,930

(22) PCT Filed: Jul. 16, 2008

(86) PCT No.: PCT/EP2008/059279

§ 371 (c)(1),
(2), (4) Date: Feb. 16, 2010

(87) PCT Pub. No.: WO2009/016033

PCT Pub. Date: Feb. 5, 2009

(65) Prior Publication Data

US 2010/0162628 A1 Jul. 1, 2010

(30) Foreign Application Priority Data

Jul. 31, 2007 (DE) ..... 10 2007 036 360

(51) Int. Cl.
*E06B 11/08* (2006.01)

(52) U.S. Cl. ..... 49/42; 49/43; 49/46

(58) Field of Classification Search ..... 49/42, 43, 49/46; 109/2, 3, 6–8, 67; 292/11, 13, 21, 292/30, 53, 92–94, 237, 201, 251.5, 341.16
See application file for complete search history.

(56) References Cited

U.S. PATENT DOCUMENTS

| | | | | | |
|---|---|---|---|---|---|
| 1,221,268 | A | | 4/1917 | Andreatte | |
| 1,623,744 | A | | 4/1927 | McLaughlin | |
| 2,504,535 | A | * | 4/1950 | Kilpatrick | 49/47 |
| 3,445,962 | A | * | 5/1969 | Bates et al. | 49/47 |
| 3,795,075 | A | * | 3/1974 | Orzechowski | 49/46 |
| 3,978,613 | A | * | 9/1976 | Hayward et al. | 49/46 |
| 5,072,543 | A | * | 12/1991 | Tetherton | 49/47 |
| 5,088,235 | A | * | 2/1992 | Trikilis | 49/42 |
| 5,146,711 | A | | 9/1992 | Gallenschütz et al. | |
| 5,435,100 | A | * | 7/1995 | Kuisis | 49/46 |
| 5,605,015 | A | * | 2/1997 | Uhl et al. | 49/47 |
| 6,065,246 | A | | 5/2000 | Detassis | |

FOREIGN PATENT DOCUMENTS

| | | |
|---|---|---|
| DE | 40 07 303 | 7/1991 |
| WO | WO 97/38203 | 10/1997 |

* cited by examiner

*Primary Examiner* — Katherine W Mitchell
*Assistant Examiner* — Justin Rephann
(74) *Attorney, Agent, or Firm* — Collard & Roe, P.C.

(57) ABSTRACT

The invention relates to an access lock for the cyclical opening up of a passageway, with a movable support element, the movement of which is transmitted to an arrangement of locking elements which are movable by means of movement of the support element within guide elements, which delimit the passageway, wherein the support element in each case has one or more first and active surfaces which face in opposite directions, and with a locking device for blocking the movement of the support element, the locking device having two bolts which are movable between a locking position and a release position, wherein a first of the bolts in the locking position thereof, bears against the first active surface or against one of the first active surfaces, and the second bolt, in the locking position thereof, bears against the second active surface or against one of the second active surfaces.

14 Claims, 3 Drawing Sheets

ACCESS LOCK

CROSS REFERENCE TO RELATED APPLICATIONS

Figure 1:
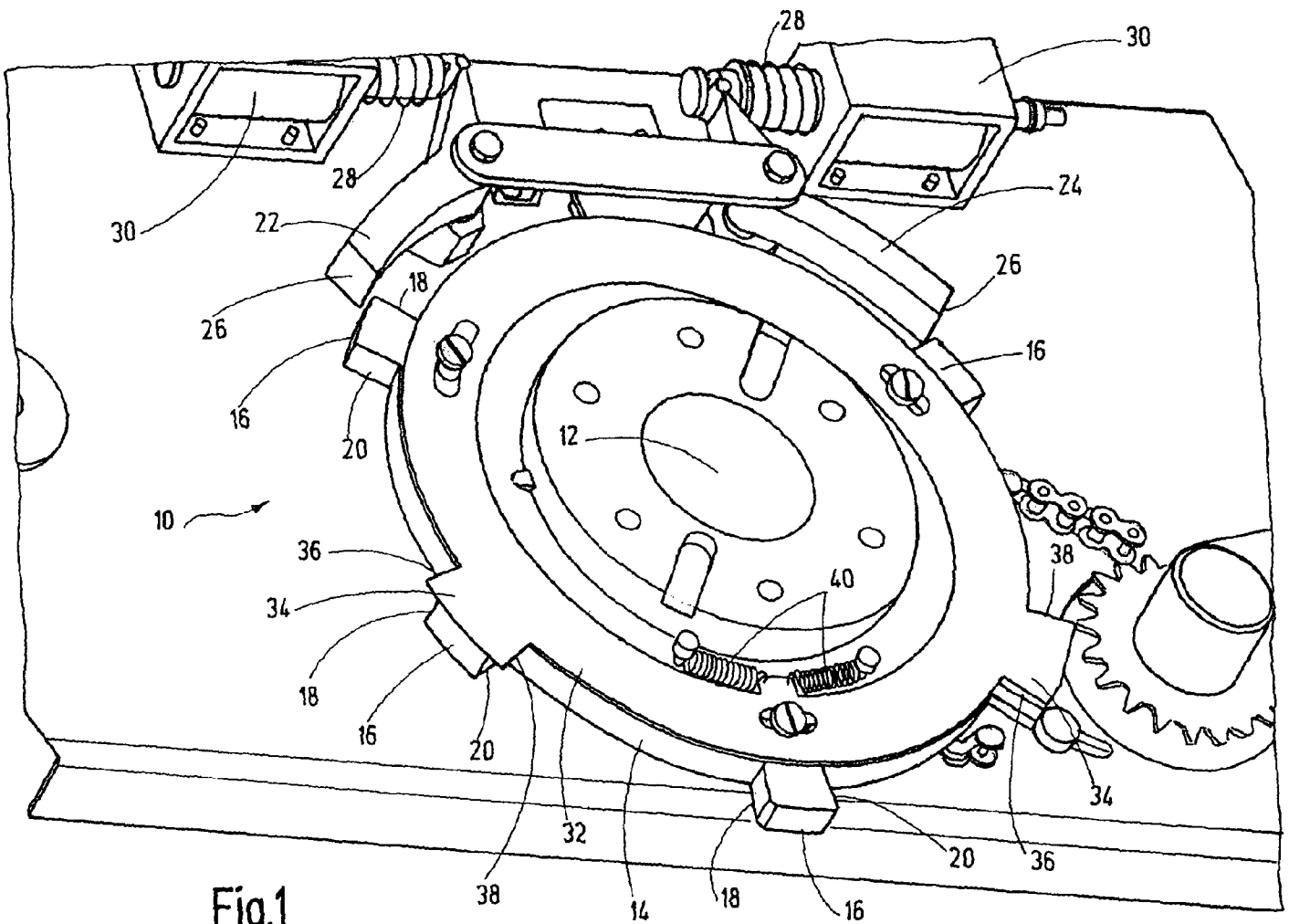

This application is the National Stage of PCT/EP2008/059279 filed on Jul. 16, 2008, which claims priority under 35 U.S.C. §119 of German Application No. 10 2007 036 360.7 filed on Jul. 31, 2007. The international application under PCT article 21(2) was not published in English.

The invention relates to a security gate in accordance with the preamble of claim 1.

Security gates in the form of revolving doors or turnstiles serve for cyclical release of a passageway, whereby blocking elements that block the passageway can be moved within guide elements that delimit the passageway. The blocking elements are, for example, the door panels of a revolving door or the crossbars of a turnstile. To block movement of the carrier element, and thus to block the passageway, a locking device is provided, whose latches can be moved between a locking position and a release position. In the locking position, a latch lies against an active surface of the carrier element and thus inhibits its movement. In this connection, the carrier element has at least a first and a second active surface, which point in opposite directions, thereby making it possible to block the movement of the carrier element in both movement directions. For this purpose, the locking device generally has two latches, a first of which lies against one of the first active surfaces in its locking position, and a second lies against one of the second active surfaces that points in the opposite direction. Here, in the opposite direction is understood to mean that movement of the carrier elements in opposite directions can be blocked by means of the latches. For this purpose, the surface normal lines on the first and second active surfaces do not necessarily have to enclose an angle of precisely 180°.

In one of the possible modes of operation, the latches are actively held in the release position against a reset force, for example by means of the force of an electromagnet. Shut-off of the electromagnet then leads to dropping of the latches into the locking position. If both latches fall into their locking position at the same time, there is the risk that a person is locked into the security gate and can no longer get out, for example in the event of a power failure. In order to counter this risk, a safety security lock was already proposed in DE 40 07 303 C2, in which the active surfaces are disposed on cams that project radially from an axis of rotation. The latches are spaced apart from one another in such a manner that their contact surfaces that make contact with the active surfaces in the locking position demonstrate a greater angular distance with reference to the axis of rotation than the active surfaces. In this way, the possibility that both latches can fall into their locking position at the same time is prevented. However, the design is rather complicated, and it is not possible to retrofit a conventional security gate, as described above, with this system. Vice versa, it is not easily possible to change the design in such a manner that simultaneous blockage in both directions is possible, if this is desired.

It is therefore the task of the invention to further develop a security gate of the type stated initially, in such a manner that locking a person in can be prevented, if necessary.

This task is accomplished, according to the invention, by means of a security gate having the characteristics of claim 1. Advantageous further developments are the object of the dependent claims.

The invention is based on the idea that the two latches are prevented from simultaneously falling into the locking position, at least in certain positions of the security gate, by means of the control element disposed on the carrier element in movable manner. In this way, it can be prevented that persons are locked into the security gate and cannot get free, at least in one direction. Furthermore, it is possible to retrofit security gates that are operated without the control element, at first, by means of installing the control element on the carrier element. Finally, the security gate can be rebuilt, by simple removal of the control element, in such a manner that controlled, for example manually controlled blockage in both directions at the same time is also possible. The security gate according to the invention is therefore structured according to the modular principle.

It is preferred that the carrier element and the control element are mounted so as to rotate about a common axis of rotation. In this way, the fact that in the case of most security gates, the blocking elements run on a cyclical track, which is most easily implemented by means of a rotational movement of the carrier element, is taken into account. In this connection, it is practical if the carrier element has at least one radially projecting locking cam having a first and a second active surface, while the control element has at least one radially projecting control cam having a first and a second control surface.

Fundamentally, it is possible that the security gate has a gear mechanism for transferring the movement of the carrier element to the blocking elements. In this way, it is possible, on the one hand, to convert a linear movement of the carrier element, for example, into a movement of the blocking elements on a closed circumferential track. On the other hand, it is also possible to transfer the movement of the carrier element to the blocking elements with a translation, so that a full rotation of the blocking elements is achieved by means of multiple rotations of the carrier element, for example. A simple structure is obtained, however, if the blocking elements are firmly connected with the carrier element, so that a rotation of the carrier element by 360° is converted to a complete rotation of the blocking elements in the guide elements. In this connection, it is preferred that the blocking elements extend away from the carrier element at equal angular distances, relative to one another, in the radial direction. Furthermore, it is preferred that the carrier element is provided with multiple locking cams, which project from the carrier element at equal angular distances, relative to one another.

It is practical if the latches have a contact surface, in each instance, which lies against one of the active surfaces and one of the control surfaces in the locking position. In this connection, two variants are fundamentally possible. For one thing, the latches can have such a distance from one another that their contact surfaces have an angular distance, in the locking position, with reference to the axis of rotation, that corresponds to the angular distance of a first active surface of one of the locking cams and a second active surface of another locking cam. The latches are then disposed in such a manner that they always interact with two different locking cams. For another thing, the latches can have such a distance from one another that their contact surfaces have an angular distance, in the locking position, with reference to the axis of rotation, that corresponds to the angular distance of the first and the second active surface of the same locking cam. In this case, the two latches always act on the same locking cam.

According to a first advantageous embodiment, the control element is provided with a number of control cams that corresponds to the number of locking cams, which control cams project away from the control element at the same angular distances from one another. In this way, the result is achieved that in no case can the rotation of the carrier element be blocked in both directions. According to an alternative embodiment, the control element is provided with a number of control cams that corresponds to half the number of the locking cams, which control cams project away from the control element at the same angular distances from one another. In this case, there are not only positions in which the rotation of the carrier element can be blocked in both directions at the same time, but also positions in which blocking in only one direction of rotation is possible.

It is practical if the control element can be rotated, in limited manner, relative to the carrier element, against a reset force. In this connection, it is advantageous if each control cam is assigned to a locking cam. Preferably, each control cam is wider than the related locking cam, and covers the latter.

Figure 2A:
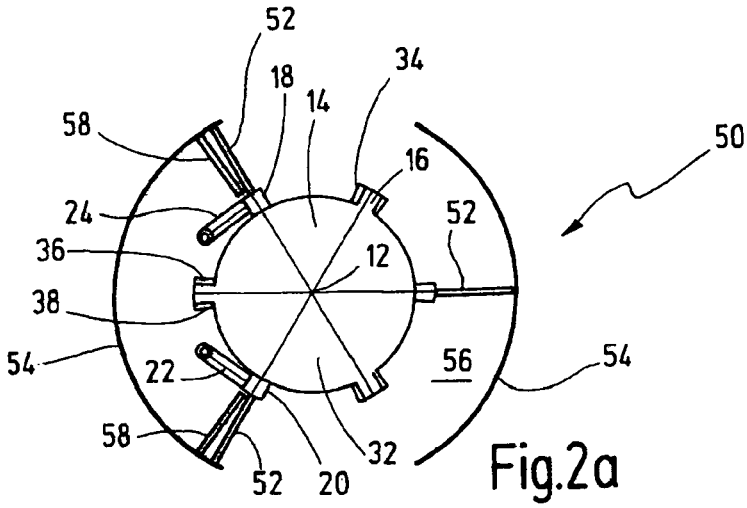
Figure 2C:
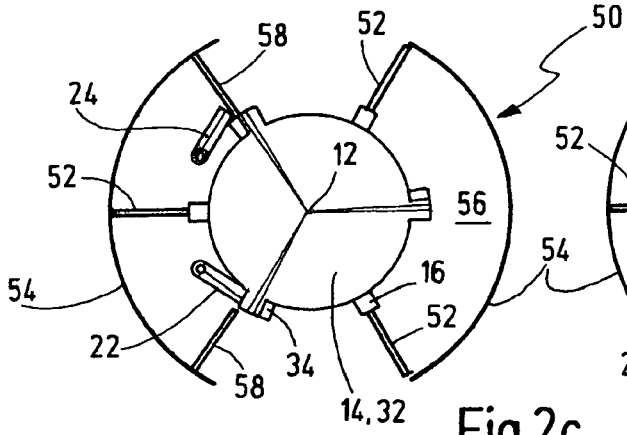
Figure 2B:
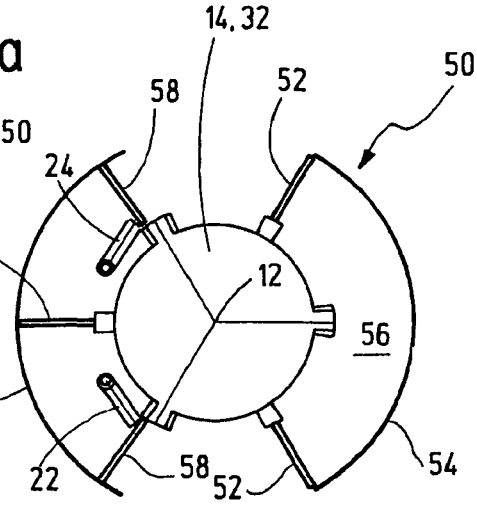
Figure 2D:
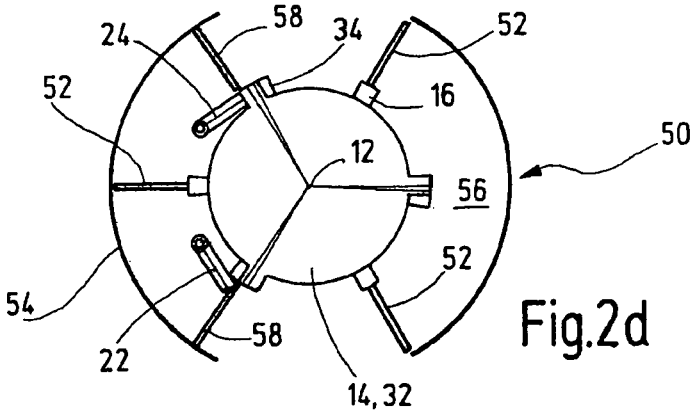
Figure 3A:
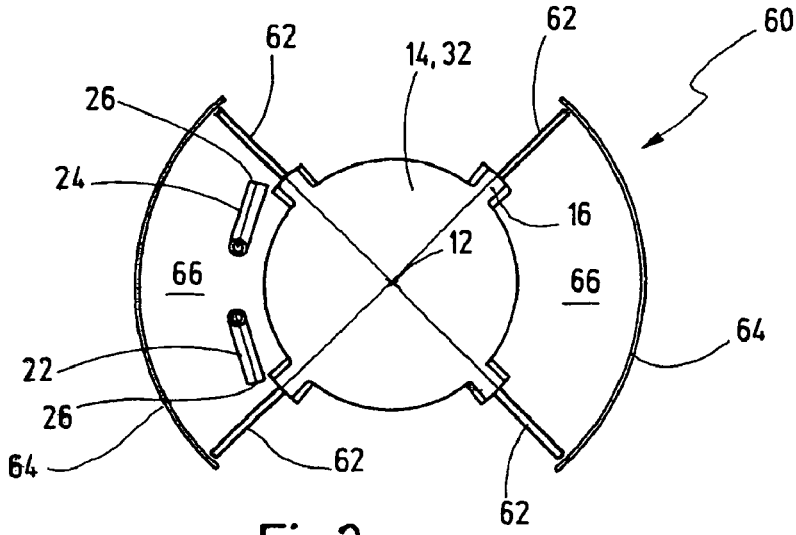
Figure 3B:
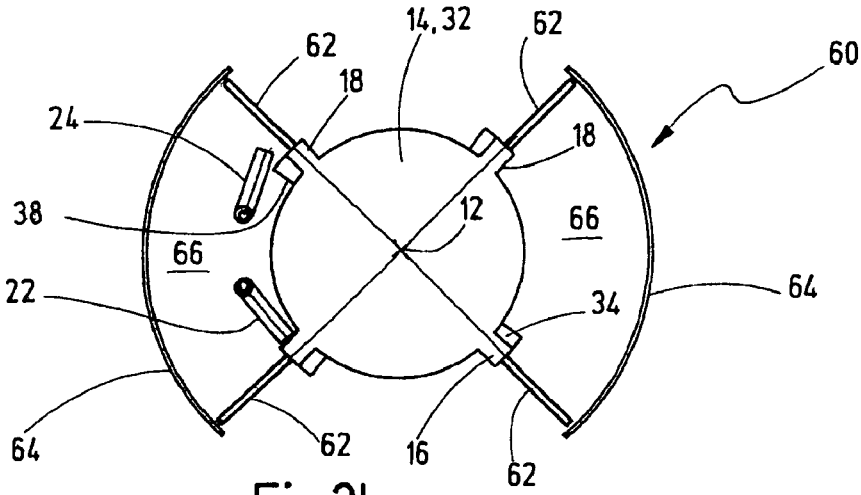
Figure 3C:
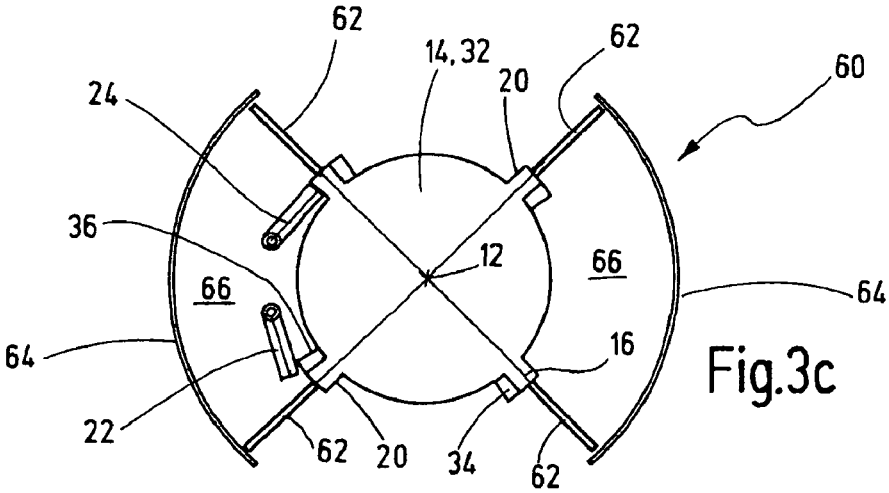

In the following, the invention will be explained in greater detail using exemplary embodiments shown schematically in the drawing. This shows FIG. 1 a blocking mechanism of a security gate, in a schematic representation;

FIGS. 2*a* to 2*d* the method of operation of a turnstile, in a schematic representation and FIGS. 3*a* to 3*c* the method of operation of a revolving door, in a schematic representation.

The blocking mechanism 10 for a security gate shown in FIG. 1 has a carrier element 14, which can be rotated about an axis of rotation 12, in the form of a disk from which six locking cams 16 project, in the radial direction, at constant angular distances from one another. Each of the locking cams 16 has a first active surface 18 that points in the clockwise direction, and a second active surface 20 that points in the counterclockwise direction. The rotational movement of the carrier element 14 is directly coupled with a movement of the blocking elements of the security gate, so that blockage of the carrier element 14 brings about blockage of the movement of the blocking elements. In order to be able to block the movement of the carrier element 14, a first latch 22 and a second latch 24 are provided, which have a contact surface 26, in each instance. Each of the latches 22, 24 can be pivoted between a locking position and a release position. In the release position, as it is shown in FIG. 1 for both latches 22, 24, the latch in question does not inhibit rotation of the carrier element 14. In its locking position, the latch 22, 24 in question blocks rotation of the carrier element 14, in that the contact surface 26 of the first latch 22, for example, comes to make contact with one of the first active surfaces 18, or the contact surface 26 of the second latch 24 comes to make contact with one of the second active surfaces 20. A spring 28, whose spring force is intended to move the latches 22, 24 into their release position, acts on each of the latches 22, 24. A movement into the locking position takes place by means of electromagnets 30, the force of which overcomes the spring force when activated.

A control element in the form of a control disk 32 is disposed on the carrier element 14; this control element can also rotate about the axis of rotation 12 and furthermore can be rotated, in limited manner, relative to the carrier element 14. Three control cams 34 project away from the control disk 32, in the radial direction, at constant angular distances from one another, which cams are wider than the locking cams 16. Each of the control cams 34 has a first control surface 36 that points in the clockwise direction and a second control surface 38 that points in the counterclockwise direction. The control cams 34 are disposed to cover every second locking cam 16, whereby they project beyond the active surfaces 18, 20 of these locking cams 16 with their control surfaces 36, 38. The control disk 32 can be rotated in both directions of rotation, relative to the carrier element 14, counter to the force of two reset springs 40, somewhat further than until either the first control surfaces 36 align with the first active surfaces 18 or the second control surfaces 38 align with the second active surfaces 20. The two latches 22, 24 are disposed at such a distance from one another that their contact surfaces 26 have an angular distance, in the locking position, with reference to the axis of rotation 12, that corresponds to the angular distance of the first active surface 18 of one of the locking cams 16 and the second active surface 20 of the next plus one locking cam 16, or is slightly greater.

In FIGS. 2*a* to 2*d*, the method of operation of a turnstile 50 equipped with the blocking mechanism 10 according to FIG. 1 is illustrated. The turnstile 50 has three crossbars 52 that are firmly connected with the carrier element 14, and extend away from the axis of rotation 12, in the radial direction, proceeding from the locking cams 16 that are not covered by a control cam 34. The crossbars 52 move within guide elements 54, whereby a passage region 56 is formed in the right region shown in FIGS. 2*a* to 2*d*. The left region is blocked off by restriction elements 58, between which the crossbars 52 can be moved through. In the position shown in FIG. 2*a*, only one of the crossbars 52 projects into the passage region 56 and blocks it. The two latches 22, 24 lie against the active surfaces 18, 20 of two locking cams 16 that are not covered by control cams 34. Rotation of the carrier element 14, and thus movement of the crossbars 52, is therefore blocked. A person who is situated in the passage region 56 can, however, leave the turnstile 50 on one side or the other.

When the passageway is released by means of moving the latches 22, 24 into their release position, a person who is situated in the passage region 56 can move the crossbars 52 into the position shown in FIG. 2*b*. In this position, the passage region 56 is closed off by one of the guide elements 54 and two of the crossbars 52, so that the person can only leave the passage region 56 if the crossbars 52 can be moved further. This is where the control disk 32 comes into use: As shown in FIG. 2*b*, the control surfaces 36, 38 that project over the active surfaces 18, 20 of the locking cams 16 prevent the latches 22, 24 from falling into the locking position.

Clockwise rotation can be blocked by moving the first latch 22 into its locking position, as shown in FIG. 2*c*. In this connection, however, the first latch 22 also comes to lie against one of the first control surfaces 36, and brings about rotation of the control disk 32 relative to the carrier element 14, into a first safety position. Projection of the second control surfaces 38 over the second active surfaces 20 then prevents movement of the second latch 24 into its locking position, so that a person locked into the passage region 56 can free himself/herself again by turning the crossbars 52 counterclockwise. The opposite situation is described in FIG. 2*d*. Here, the second latch 24 blocks counterclockwise rotation of the carrier element 14 by making contact with one of the second active surfaces 20. However, the contact surface 26 of the second latch 24 also lies against one of the second control surfaces 38, so that the first control surfaces 36 project over the first active surfaces 18 and prevent movement of the first latch 22 into its locking position. The control disk 32 is in a second safety position, and a person locked into the passage region 56 can free himself/herself again by turning the crossbars 52 clockwise.

FIGS. 3*a* to 3*c* show the application of the principle to a four-panel revolving door 60. This door has four door panels 62 that are firmly connected with the carrier element 14, which has only four locking cams 16 in this exemplary embodiment. The door panels 62 extend from the locking cams 16 in the radial direction, with reference to the axis of rotation 12. Rotation of the carrier element 14 brings about a movement of the door panels 62 within guide elements 64, whereby contrary to the exemplary embodiment according to FIGS. 2*a* to 2*d*, no restriction element is provided. Thus, the revolving door 60 has two passage regions 66. This fact requires an adaptation of the design, since persons can be locked into both passage regions 66. Thus, the control disk 32 has four control cams 34, so that each locking cam 16 is covered by a control cam 34.

Furthermore, the angular distance of the two contact surfaces 26, in the locking position, corresponds to the angular distance of the first active surface 18 of one of the locking cams 16 and the second active surface 20 of the next locking cam 16. In FIG. 3*a*, it is shown how the two latches 22, 24 are situated in the release position and are prevented from moving into the locking position by the control cams 34, with their control surfaces 36, 38 that project over the active surfaces 18, 20. FIG. 3*b* shows a blockage of the rotational movement clockwise, which is brought about by contact of the contact surface 26 of the first latch 22 on one of the first active surfaces 18. The second latch 24 is prevented from moving into the locking position by one of the control cams 34, the second control surface 38 of which projects over the second active surface 20 of the locking cam 16 in question, so that persons locked into the passage regions 66 can free themselves by turning the door panels 62 counterclockwise. The same principle applies in the position according to FIG. 2*c*. Here, the second latch 24 blocks counterclockwise rotation, while the first latch 22 is prevented from moving into its locking position. Persons locked into the passage regions 66 can free themselves by turning the door panels 62 clockwise. In FIG. 3*b*, the control disk 32 is in the first safety position, and in FIG. 3*c*, it is in the second safety position.

In summary, the following should be stated:

The invention relates to a security gate 50, 60 for cyclical release of a passageway, having a movable carrier element 14, whose movement is transferred to an array of blocking elements 52, 62, which can be moved by means of a movement of the carrier element 14 within guide elements 54, 64 that delimit the passageway, whereby the carrier element 14 has one or more first and second active surfaces 18, 20, in each instance, which point in opposite directions, and having a locking device for blocking the movement of the carrier element 14, which device has two latches 22, 24 that can be moved between a locking position and a release position, whereby a first one of the latches 22 lies against the first active surface 18 or one of the first active surfaces 18 in its locking position, and the second latch 24 lies against the second active surface 20 or one of the second active surfaces 20 in its locking position. According to the invention, it is provided that a control element 32 that can be moved relative to the carrier element 14 and has one or more first and second control surfaces 36, 38 is disposed on the carrier element 14, which control surfaces can be moved between a first and a second safety position by moving the control element 32 relative to the carrier element 14, whereby in the first safety position, the first control surface 36 or one of the first control surfaces 36 is disposed relative to the first active surface 18 or to one of the first active surfaces 18 in such a manner that the first latch 22 lies against the first control surface 36 in its locking position, while the second control surface 38 or one of the second control surfaces 38 projects over the second active surface 20 or one of the second active surfaces 20, thereby preventing movement of the second latch 24 into its locking position, and whereby in the second safety position, the second control surface 38 or one of the second control surfaces 38 is disposed relative to the second active surface 20 or to one of the second active surfaces 20 in such a manner that the second latch 24 lies against the second control surface 38 in its locking position, while the first control surface 36 or one of the first control surfaces 36 projects over the first active surface 18 or one of the first active surfaces 18, thereby preventing movement of the first latch 22 into its locking position.

The invention claimed is:

1. Security gate for cyclical release of a passageway, having a movable carrier element (14), whose movement is transferred to an array of blocking elements (52, 62), which are movable by means of a movement of the carrier element (14) within guide elements (54, 64) that delimit the passageway, whereby the carrier element (14) has one or more first and second active surfaces (18, 20), in each instance, which point in opposite directions, and having a locking device for blocking the movement of the carrier element (14), which device has two latches (22, 24) that are movable between a locking position and a release position, whereby a first one of the latches (22) lies against the first active surface (18) or one of the first active surfaces (18) in its locking position, and the second latch (24) lies against the second active surface (20) or one of the second active surfaces (20) in its locking position, wherein a control element (32) that is movable relative to the carrier element (14) and has one or more first and second control surfaces (36, 38) is disposed on the carrier element (14), which control surfaces are movable between a first and a second safety position by moving the control element (32) relative to the carrier element (14), whereby in the first safety position, the first control surface (36) or one of the first control surfaces (36) is disposed relative to the first active surface (18) or to one of the first active surfaces (18) in such a manner that the first latch (22) lies against the first control surface (36) in its locking position, while the second control surface (38) or one of the second control surfaces (38) projects over the second active surface (20) or one of the second active surfaces (20), thereby preventing movement of the second latch (24) into its locking position, and whereby in the second safety position, the second control surface (38) or one of the second control surfaces (38) is disposed relative to the second active surface (20) or to one of the second active surfaces (20) in such a manner that the second latch (24) lies against the second control surface (38) in its locking position, while the first control surface (36) or one of the first control surfaces (36) projects over the first active surface (18) or one of the first active surfaces (18), thereby preventing movement of the first latch (22) into its locking position.

2. Security gate according to claim 1, wherein the carrier element (14) and the control element (32) are mounted to rotate about a common axis of rotation (12).

3. Security gate according to claim 2, wherein the carrier element (14) has at least one radially projecting locking cam (16) that has a first and a second active surface (18, 20), and wherein the control element (32) has at least one radially projecting control cam (34) that has a first and a second control surface (36, 38).

4. Security gate according to claim 3, wherein the carrier element (14) is provided with multiple locking cams (16) that project away from the carrier element (14) at the same angular distances.

5. Security gate according to claim 4, wherein the control element (32) is provided with a number of control cams (34) that corresponds to the number of the locking cams (16), which control cams project away from the control element (32) at the same angular distances from one another.

6. Security gate according to claim 4, wherein the control element (32) is provided with a number of control cams (34)

that corresponds to half the number of the locking cams (16), which control cams project away from the control element (32) at the same angular distances from one another.

7. Security gate according to claim 2, wherein the control element (32) can be rotated, in limited manner, relative to the carrier element (14), counter to a reset force.

8. Security gate according to claim 7, wherein each control cam (34) is assigned to a locking cam (16).

9. Security gate according to claim 8, wherein each control cam (34) is wider than the related locking cam (16) and covers it.

10. Security gate according to claim 1, comprising a gear mechanism for transferring the movement of the carrier element (14) to the blocking elements (52, 62).

11. Security gate according to claim 1, wherein the blocking elements (52, 62) are firmly connected with the carrier element (14).

12. Security gate according to claim 1, wherein the latches (22, 24) each have a contact surface (26) that lies against one of the active surfaces (18, 20) and one of the control surfaces (36, 38) in the locking position.

13. Security gate according to claim 12, wherein the latches (22, 24) have such a distance from one another that their contact surfaces (26) have an angular distance, in the locking position, with reference to the axis of rotation (12), that corresponds at least to the angular distance of a first active surface (18) of one of the locking cams (16) and a second active surface (20) of another locking cam (16).

14. Security gate according to claim 12 , wherein the latches (22, 24) have such a distance from one another that their contact surfaces (26) have an angular distance, in the locking position, with reference to the axis of rotation (12), that corresponds at least to the angular distance of the first and the second active surface (18, 20) of the same locking cam (16).

* * * * *